US007097491B2

(12) United States Patent
Neumann-Henneberg

(10) Patent No.: US 7,097,491 B2
(45) Date of Patent: Aug. 29, 2006

(54) PLUG CONNECTOR

(76) Inventor: Wolf Neumann-Henneberg, Dürbheimerstr.41, D-78604 Rietheim-Weilheim (DE)

( * ) Notice: Subject to any disclaimer, the term of this patent is extended or adjusted under 35 U.S.C. 154(b) by 0 days.

(21) Appl. No.: 11/207,331

(22) Filed: Aug. 19, 2005

(65) Prior Publication Data

US 2006/0040545 A1 Feb. 23, 2006

(30) Foreign Application Priority Data

Aug. 23, 2004 (DE) ..... 10 2004 040 834

(51) Int. Cl.
*H01R 4/24* (2006.01)

(52) U.S. Cl. ..... 439/395; 439/948

(58) Field of Classification Search ..... 439/395, 439/404, 861, 620, 622
See application file for complete search history.

(56) References Cited

U.S. PATENT DOCUMENTS

| | | | | |
|---|---|---|---|---|
| 3,076,172 A | | 1/1963 | Carr et al. | |
| 3,221,293 A | | 11/1965 | Regan | |
| 3,503,036 A | | 3/1970 | Desso et al. | |
| 3,524,161 A | | 8/1970 | Frantz et al. | |
| 4,113,340 A | * | 9/1978 | Rapata | 439/490 |
| 4,830,631 A | * | 5/1989 | Hsueh | 439/622 |
| 5,025,121 A | * | 6/1991 | Allen et al. | 200/275 |
| 5,052,953 A | | 10/1991 | Weber | |
| 5,533,910 A | * | 7/1996 | Korner et al. | 439/395 |
| 6,039,607 A | * | 3/2000 | Cheung | 439/622 |
| 6,062,916 A | | 5/2000 | Gladd et al. | |
| 6,319,046 B1 | | 11/2001 | Feye-Hohmann et al. | |
| 6,921,301 B1 | | 7/2005 | Conrad | |
| 2004/0185722 A1 | | 9/2004 | Conrad | |

FOREIGN PATENT DOCUMENTS

| | | |
|---|---|---|
| DE | 1 903 043 | 8/1969 |
| DE | 101 17 061 A1 | 10/2002 |
| DE | 101 49 574 C2 | 4/2003 |
| DE | 103 10 899 B3 | 5/2004 |
| EP | 0 959 529 A2 | 11/1999 |
| FR | 2.004.831 | 12/1969 |

* cited by examiner

*Primary Examiner*—Tulsidas C. Patel
*Assistant Examiner*—Vladimir Imas
(74) *Attorney, Agent, or Firm*—Renner, Otto, Boisselle and Sklar, LLP

(57) ABSTRACT

The invention concerns a plug connector for establishing a contact between an electrical component and a conductor bar of a lead frame (not shown). The plug connector has a lamellae packet with contact lamellae into whose slot the electrical conductor can be inserted. The invention proposes to place a spacer lamella between each two adjacent contact lamellae that would limit the insertion depth of the electrical conductor in the slot and would hold the electrical conductor in the slot between the contact springs by means of barbs.

14 Claims, 3 Drawing Sheets

16
10
18
14
12
22
20
34

30
24
28
26
32
34

38
36
30
16
38
18
44
14
40
40
24,28
22
26
12
10
20
42
34

PLUG CONNECTOR

TECHNICAL FIELD

The invention concerns a plug. The plug connector is intended for establishing a—preferably non-permanent—electrical connection of a wire or lead with the conductor bar of a lead frame.

BACKGROUND OF THE INVENTION

From DE 103 10 899 B3, a blade contact receptacle is known that has a number of contact lamellae arranged congruently one behind the other that are each divided by a slot into two contact springs between which a blade contact can be inserted. The contact lamellae are twisted 90° in relation to their foot section, which creates an air gap between them, permitting unimpeded and independent spring action of the contact springs of the contact lamellae. This familiar blade contact receptacle has soldering pins for soldering into a circuit board.

A similar blade contact receptacle is known from U.S. Pat. No. 5,052,953 that also has contact lamellae that are spaced through soldering into a circuit board. Electrically insulating spacer lamellae may be provided between the contact lamellae in the foot section.

From DE 101 49 574 C2, a blade contact receptacle is known that can be inserted into or through a slot or stamped hole in a conductor bar of a lead frame, and can be attached to the conductor bar by means of welding. Lead frames are used in automobile manufacturing, among others. They consist of one or several metal sheets in one or several planes that are stamped to form lead frames for connecting electrical components with each other, similar to the conductors of printed circuits. Compared with printed circuits, lead frames allow currents that are higher by several magnitudes. The familiar blade contact receptacle has a number of identical contact lamellae that are packeted in a uniform stack. The packeted contact lamellae form the blade contact receptacle. The contact lamellae have a slot that is open at one end and that divides them into two contact springs that are joined to form one piece in the foot section of the contact lamella. A blade contact, i.e. an electrical contact consisting of a strip of metal, can be inserted into the slot of the packeted contact lamellae that form the blade contact receptacle.

From DE 19 03 043 A, a multi-pole electrical plug connection is known that has congruent contact elements that are arranged with spaces in between and have the shape of blade contact receptacles. The contact lamellae are electrically insulated from each other and are inserted into an electrically insulating housing. The foot sections of the contact lamellae form soldering pins that can be soldered into a circuit board. A second circuit board can be inserted into the slots of the contact lamellae, perpendicular to the first circuit board. This makes it possible to electrically connect conductors of the two circuit boards with each other. Conductors that are electrically insulated from each other are not contacted by the known plug connection.

A comparable plug connection for connecting the conductors of two circuit boards joined in a perpendicular arrangement is disclosed by the FR 2 004 831 A1.

U.S. Pat. No. 3,221,293 and U.S. Pat. No. 3,076,172 disclose contacts that are stamped from sheet metal and bent, and into which wire connections of electrical components can be inserted. The contacts are bent in 3 dimensions and have no contact lamellae.

SUMMARY OF THE INVENTION

The invention addresses the problem of proposing a plug connector that can be easily connected with the stripped end of a wire or lead, preferably in a permanent connection, and that forms a plug that can be inserted into a conductor bar of a lead frame.

According to the invention, this problem is solved by a plug connector which has contact lamellae, where a spacer lamella having a different shape and a different appearance than the contact lamellae is placed between adjacent contact lamellae. The contact and spacer lamellae are packeted in a lamellae packet forming a plug that can be inserted in a stamped hole in a conductor bar of a lead frame. A foot section of the packeted lamellae, i.e. the section facing away from the contact springs, forms the plug that is inserted in the stamped hole of the conductor bar.

The spacer lamellae create a distance between the contact springs of the contact lamellae. This improves the spring characteristics of the contact springs, and makes the contact springs of the contact lamellae capable of independent spring action, without interfering with each other. Also, good contact with the electrical conductor, e.g. a wire or lead, inserted into the slot of the lamellae packet is achieved. The contact pressure with which the contact springs press against the inserted electrical contact is high, and is not reduced by friction with other contact springs. "Good contact" specifically means a low electric contact resistance between the inserted conductor and the contact springs. The plug connector proposed by the invention makes high electric currents possible.

A plug connector proposed by the invention, consisting of a lamellae packet with two contact lamellae and a spacer lamella inserted between them, has four contact springs that contact the inserted electrical conductor in four places. If the plug connector has more contact lamellae, the number of contact areas on the inserted electrical conductor increases by two with each contact lamella, corresponding to the number of contact springs. This results in a correspondingly high current carrying capacity of the plug connector that can easily be increased further by increasing the number of the contact lamellae. A high current carrying capacity is of great importance in the low-voltage sector. Especially in the automotive sector, the current load keeps increasing with an ever larger number of electrical consumers with increasing electrical demands.

The lamellae of the plug connector can be stamped from sheet metal of high strength and consequently good spring characteristics. This can be done even at high temperatures because bending of the lamellae is not necessary.

The spacer lamellae have an insertion depth stop in the area of the contact lamellae slots. The insertion depth stop limits the insertion depth of an electrical conductor between the contact springs of the contact lamellae. The insertion depth stop helps with inserting an electrical contact into the desired position in the plug connector. Insertion into the correct position is the prerequisite for a good contact. The insertion depth stop prevents an undesirably deep insertion of the electrical conductor into the slot of the contact lamellae.

According to the invention, the plug connector remains permanently as a plug on an electrical conductor inserted into the slot of its contact lamellae, i.e. the inserted electrical conductor is not intended to be pulled out of the plug connector for the purpose of disconnecting the plug connection. Rather, the removable plug connection is represented by the plug formed by the packet of lamellae, i.e. in order to disconnect the plug connection, the lamellae packet of the plug connector proposed by the invention that is inserted into the stamped hole of a conductor bar of the lead frame is pulled out of the conductor bar. In this manner, the plug connector proposed by the invention makes it possible to attach a plug to a cable, a lead, or a connecting wire of an electrical or electronic component by simply plugging it in, without the extra effort required by a crimped connection or a connection made with clamping screws. However, the invention does not preclude an electrical conductor inserted into the slot of the contact lamellae from being pulled out again.

As an alternative, or in addition to the insertion depth stop, the spacer lamella has at least one barbed element with spring action that positively snaps behind an electrical conductor inserted into the slot of the contact lamellae, or catches it from behind. The barbed element may be of similar design as the contact springs, but has a barb that engages the inserted electrical conductor from behind, thereby holding it in the slot of the contact lamellae. A snap-type engagement means that the inserted conductor can be removed, i.e. pulled from the slot of the contact lamellae with a push-button-like action. In a catch-type engagement, the electrical conductor can only be removed by bending the barbed element to the side. With a wire or lead, it is a simple matter for the barbed element to engage them from behind. If a flat or blade contact is inserted, it may have a recess that can be engaged by the barbed element. The barbed element ensures a good mechanical connection of the plug connector with an inserted electrical conductor.

One design variant of the invention provides for a cage to hold the lamellae packet of the plug connector. For example, this cage may consist of a stamped and bent piece of sheet metal that holds the lamellae of the plug connector in form of a lamellae packet. The cage may also be made of plastic, for example, forming a housing for the plug connector. The cage improves the mechanical strength of the plug connector proposed by the invention and prevents the lamellae packet from falling apart during storage, transportation, and handling. In addition, an electrically insulating housing enclosing the cage may be provided. If the cage is made of plastic, an additional housing is usually not necessary.

In principle, use of the cage is also possible for a plug connector as proposed by the invention whose lamellae packet consists exclusively of contact lamellae and no spacer lamellae. An important function of the cage is to guide and hold the contact springs at the approximate level of the contact areas. The importance of this function increases with the number of lamellae and the relative force required for inserting the electrical conductor between the contact springs.

In a preferred design of the invention, the cage is equipped with a tension relief for an electrical conductor inserted into the slot of the contact lamellae. This tension relief increases the mechanical strength of the connection. It is of special advantage if and because the plug connector proposed by the invention is not to be disconnected from an inserted electrical conductor, but if the electrical connection can be disconnected by pulling the plug connector from the stamped hole of the conductor bar.

One design variant of the invention provides for an insertion lug on the cage of the plug connector that engages a slot of the conductor bar when the plug connector is inserted into a stamped hole of the conductor bar. This improves not only the mechanical strength of the plug connection but also the electrical contact between the plug connector and the conductor bar. The cage effects, or supports the desired plugged-in position of the plug connector in the conductor bar, and a angled position of the plug connector in the raised connector as well as an angled position of the lamellae relative to each other are thereby prevented.

One design variant of the invention provides for a rest element of the plug connector with which the plug connector rests on a conductor bar when the plug connector is inserted into a stamped hole of the conductor bar. The rest element ensures the desired position of the plug connector inserted into the conductor bar relative to this bar. Besides a perpendicular orientation of the lamellae of the plug connector relative to the conductor bar, an angled orientation of the lamellae is also possible, and is also ensured by the rest element of the plug connector. The rest element is located in lateral position relative to the lamellae, and may be arranged in point-like fashion at several places around the lamellae, as a line (continuous or intermittent) around the lamellae, or may consist of a flat surface. As a point-type rest element, for example, lateral projections of the lamellae or lugs at the edge of a plug connector housing that faces the conductor bar may be used. The cage of the plug connector may also be equipped with lugs. As a line-type rest element, the edge of a housing or of the cage of the plug connector that faces the conductor bar may be used. A rest element in form of a flat surface, for example, may consist of the bottom of the housing or the cage of the plug connector.

Below, the invention is explained in detail with the help of design variants shown in the Figures.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
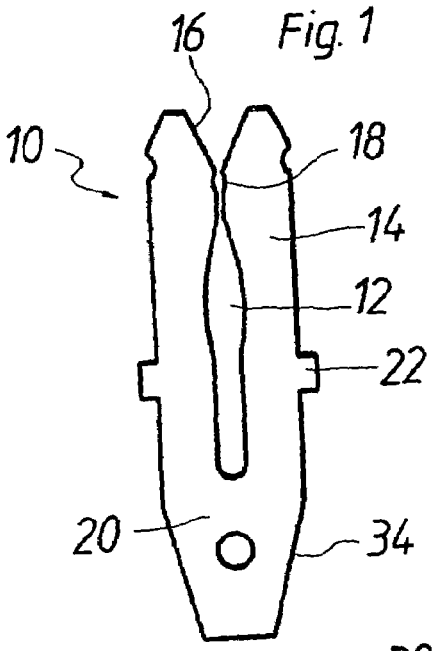
FIG. 1 shows a contact lamella of a plug connector as proposed by the invention as an individual part.

The contact lamella 10 shown in FIG. 1 is stamped from sheet metal, its contour is elongated and approximately rectangular, and it has a longitudinal slot 12 that is open at one end and divides the contact lamella 10 into two contact springs 14. The opening of the slot 12 has two insertion bevels 16 followed by concave recesses close to the opening of the slot 12. The concave recesses match the diameter of the wire to be inserted, and represent the contact areas 18. In a foot section 20, the contact springs 14 are of one piece. On its long sides, the contact lamella 10 has projections serving as stops 22 that limit the insertion depth into a conductor bar of a lead frame.

Figure 2:
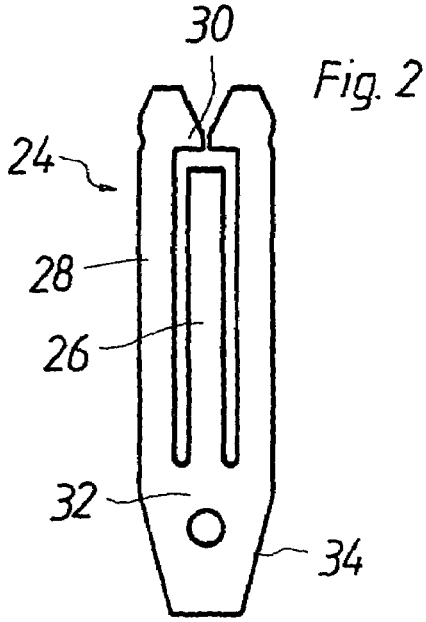
FIG. 2 shows a spacer lamella of a plug connector as proposed by the invention as an individual part.

FIG. 2 shows a spacer lamella 24 that is also stamped from sheet metal. The spacer lamella 24 has approximately the same contour as the contact lamella 10. Lengthwise in its center, the spacer lamella 24 has a tongue forming an insertion depth stop 26. If the spacer lamella 24 and the contact lamella 10 are stacked, the insertion depth stop 26 covers the slot 12 of the contact lamella 10. The insertion depth stop 26 ends directly below the contact areas 18 so that a wire that is inserted into the slot 12 at the level of the contact areas 18 rests on the insertion depth stop 26.

On the long sides adjacent to the insertion depth stop 26, the spacer lamella 24 has barbed elements 28 with spring action. The barbed elements 28 are designed as tongues with spring action, like the contact springs 14 of the contact lamella 10; at their free ends, the barbed elements have inward-facing barbs 30, i.e. the barbs face each other. In a foot section 32, the barbed elements 28 and the insertion depth stop are of one piece. The foot sections 20, 32 of the contact lamella 10 and of the spacer lamella 24 have identical contours, their outer edges have insertion bevels 34.

Figure 3:
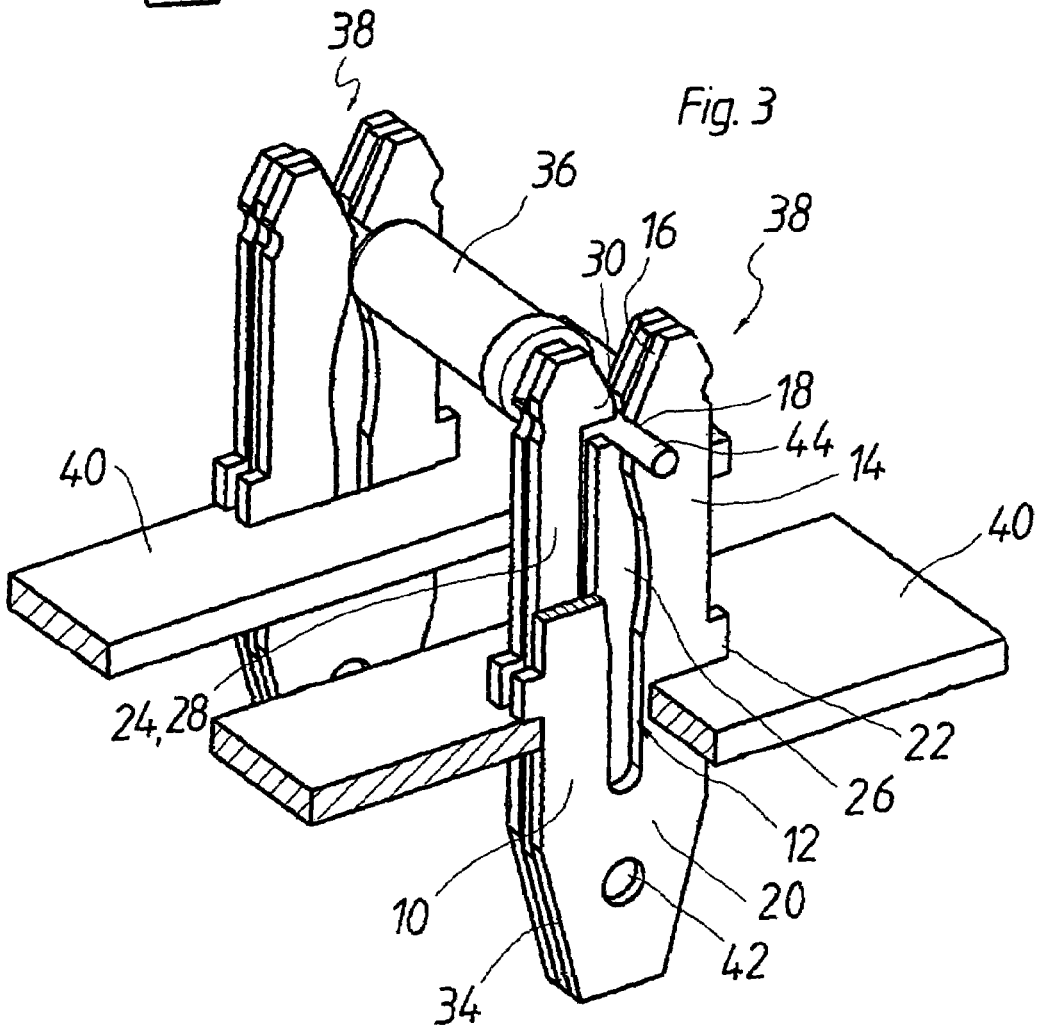
FIG. 3 shows an application of a of a plug connector as proposed by the invention.

In FIG. 3, an electrical component—in the shown design variant a resistor 36—is connected electrically with two plug connectors 38 as proposed by the invention, and mechanically with two conductor bars of a lead frame (not shown). The plug connectors 38 proposed by the invention have a number of contact lamella 10 with a spacer lamella 24 inserted between adjacent contact lamellae 10. The lamellae 10, 24 are packeted, i.e. stacked so that their contours match, to form a lamellae packet that forms the plug contact 38. In this design variant of the invention, the plug contacts 38 have two contact lamellae 10 with a spacer lamella 24 placed in between. In order to make the spacer lamella 24 visible, the contact spring 14 facing the viewer has been removed from the front contact lamella 10 of the front plug connector 38 in FIG. 3. Embossed recesses 42 in the foot sections 20, 32 of the lamellae 10, 24 serve to correctly index the packeted lamellae 10, 24 relative to each other.

The connecting wires 44 of the resistor 36 are inserted into the slots 12 of the contact lamellae 14, passing in perpendicular direction through the lamellae 10, 24. The connecting wires rest in the concave contact areas 18 of the contact springs 14 of the contact lamellae 10. The insertion depth stop 26 of the spacer lamella 24 limits the insertion depth of the connecting wire 44 and prevents the connecting wire 44 from being pushed deeper than the contact areas 18 into the slot 12. The barbed elements 28 have snapped over the connecting wires 44 of the resistor 36, with the barbs 30 passing over the connecting wires 44, holding them in the slots 12 of the contact lamellae 10. The barbed elements 28 with the barbs 30 form a catch-type connection for the connecting wires 44 that prevents the connecting wires 44 from being moved upward, i.e. out of the open end of the slot 12. The total of four contact springs 14 of the two contact lamellae 10 of each plug connector 38 have four contact areas 18 in contact with the connecting wire 44, resulting in a good electrical contact with a low contact resistance. A current of 25 A per plug connector 38 with two contact lamellae 10 and a lamella thickness of 0.4 mm poses no problems. The amperage can be further increased by increasing the number of the contact lamellae 10 and/or their thickness (not shown). In theory, this makes them suitable for any amperage, and a permanent current of more than 100 A is feasible in practice without any problems.

The foot sections 20, 32 of the lamellae 10, 24 of the plug connectors 38 form plugs and are plugged into rectangular stamped holes of the conductor bars 40. In order to disconnect this plug-in connection, the plug connectors 38 formed by the lamellae packets with the contact lamellae 10 and the spacer lamellae 24 can be pulled out of the conductor bars 40. The stops 22 limit the insertion depth of the plug connectors 38 in the conductor bars 40. An essential function of the stops 22 of the contact lamellae 10 is the correct orientation of the plug connector on the conductor bar 40. The stops 22 ensure that the plugged-in plug connector is oriented perpendicular to the conductor bar 40. It is also possible to orient the plug connector at an angle to the conductor bar 40 by staggering the stops 22 on both sides of the contact lamellae 10 in longitudinal direction (not shown). The stops 22 of the contact lamellae 10 may also be designated as the rest element of the plug connector.

Figure 4:
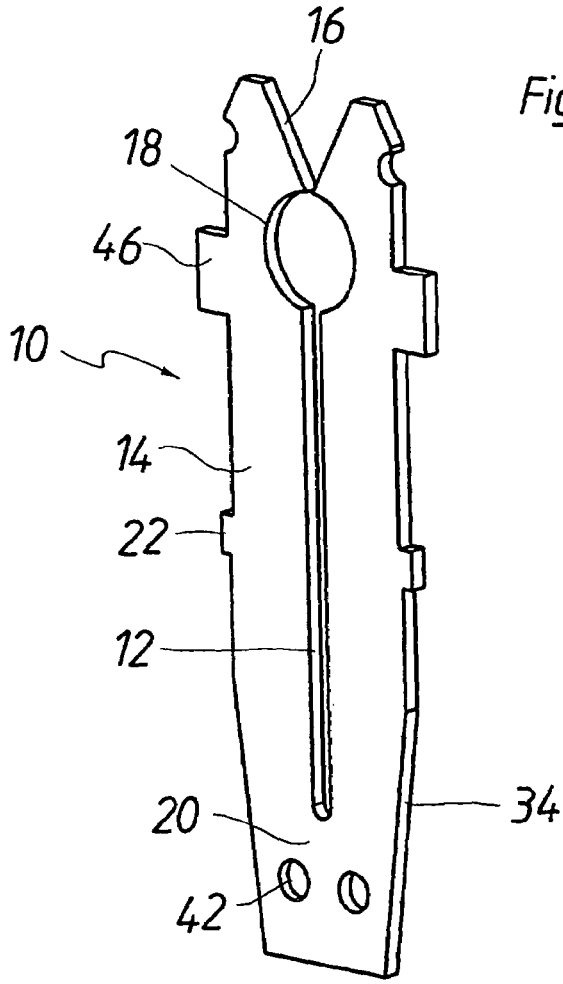
FIG. 4 shows a contact lamella of a second design variant of a plug connector as proposed by the invention as an individual part.

The contact lamella 10 shown in FIG. 4 is essentially shaped like the contact lamella 10 described above and shown in FIG. 1. Below, the same reference numbers will be used for the same components. The contact lamella 10 from FIG. 4 is also a part stamped from sheet metal with a slot 12 that divides the contact lamella 10 into two contact springs 14. It also has insertion bevels 16 and concave contact areas 18. The concave shape of the contact areas 18 conforms to the diameter of a wire to be inserted. Besides the stops 22 that limit the insertion depth into a conductor bar of a lead frame and define the position of the plug connector in the conductor bar, the contact lamella 10 in FIG. 4 has a pair of rectangular projections 46 on the long sides of the contact lamella 10. The projections 40 serve for attaching the contact lamella to a cage shown in FIG. 5 that will be explained below. The projections are located on the approximate level of the contact areas 18. The above explanations regarding FIGS. 1 and 3 are referred to in supplementing the explanation of FIG. 4.

The cage 48 shown in FIG. 4 is a stamped and bent sheet metal part. The cage 48 has a rectangular floor 50 with an approximately square opening 52 taking up a large part of the surface of the floor 50. From the long sides of the floor 50, two parallel sidewalls 54 with rectangular openings 56 extend in one direction. At one end, the sidewalls 54 project beyond the floor 50, forming flaps that are bent inward by approximately 225°. The flaps point inward at an angle and in the direction of the cage 48 interior between the sidewalls 54 and the floor 50. The flaps form the tension relief 58. At both ends of the cage, the floor 50 is bent at 90° in the opposite direction of the sidewalls 54 to form insertion lugs 60. The sidewalls 54 and the insertion lugs 60 are perpendicular to each other.

Figure 5:
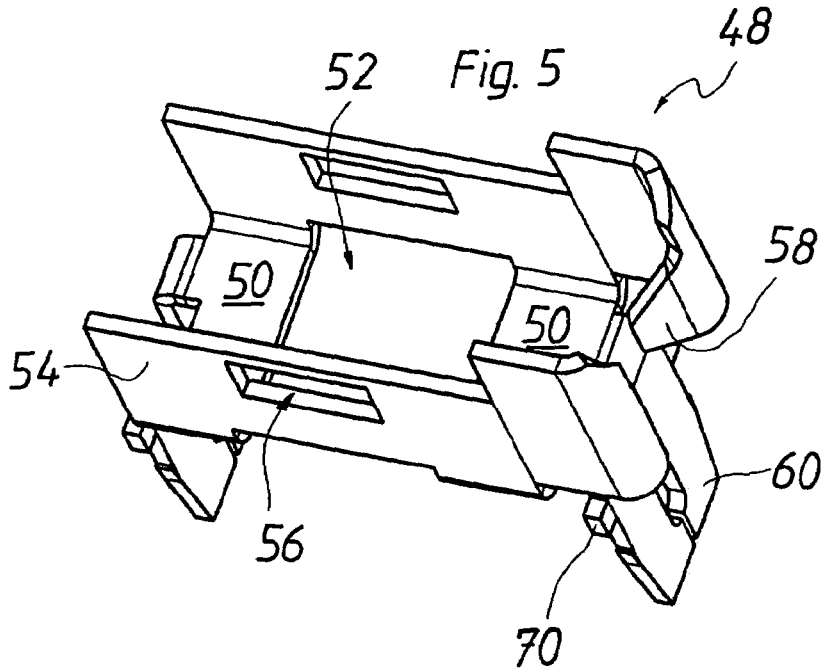
FIG. 5 shows a cage of the second design variant of the invention as an individual part.
Figure 6:
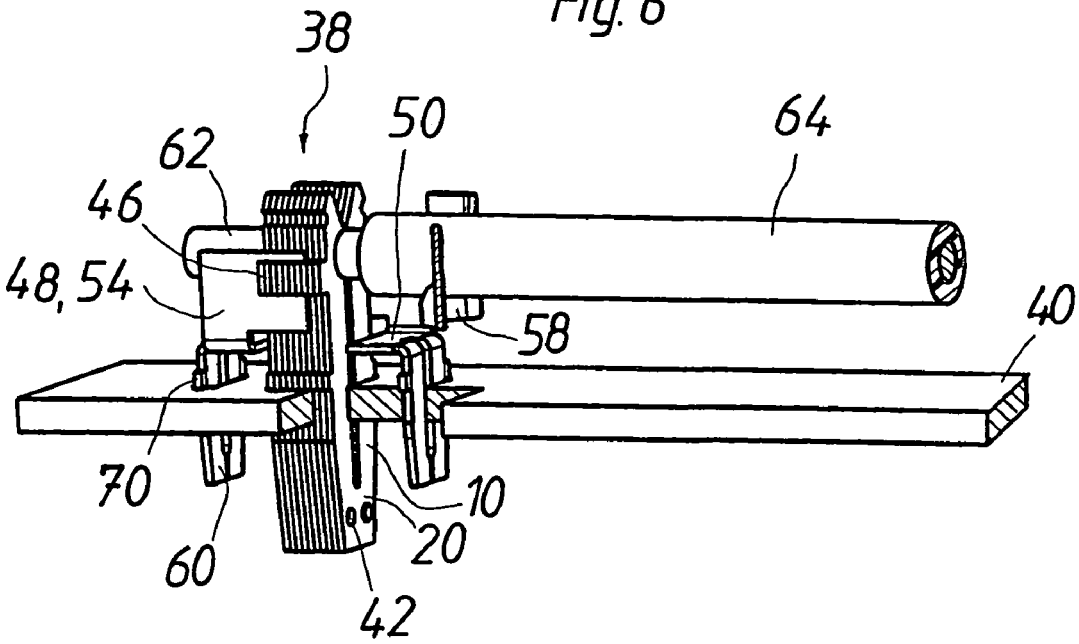
FIG. 6 shows the second design variant of a plug connector as proposed by the invention without housing.

FIG. 6 shows a plug connector 38 as proposed by the invention that includes a lamellae packet with the contact lamellae 10 shown in FIG. 4 and the cage 48 shown in FIG. 5. In the interest of better visibility, parts of the cage 48 are omitted in FIG. 6. The contact lamellae 10 are packeted, i.e. they are stacked so that their contours match. Embossed recesses 42 index the contact lamellae 10 relative to each other. The lamellae packet is inserted through the hole 52, perpendicular to the floor 50 of the cage 48, so that the contact lamellae 10 are at right angles to the sidewalls 54 and parallel to the insertion lugs 60. The foot sections 20 of the contact lamellae 10, forming a plug as in FIG. 3, protrude from the floor 50 in the same direction as the insertion lugs 60 project from the floor 50. The projections 46 of the contact lamellae 10 rest in the recesses 56 of the sidewalls 54 of the cage 48. In this manner, the contact lamellae 10 are held as a packet by and in the cage 48. Since the projections 46 are located at the approximate level of the contact areas 18 on the contact lamellae 10, the cage 48 holds and guides the contact springs 14 at the approximate level of the contact areas 18. This prevents a wire inserted in the contact areas 18 from twisting the contact lamellae 10 and ensures good electrical contact with a high contact pressure. Together with the projections 46 of the contact lamellae 10 resting in them, the recesses 56 in the side walls 54 of the cage 48 form supports and guides of the cage 48 for the contact springs 14 at the approximate level of the contact areas 18. For the cage 48 to support and guide the contact springs 14 at the approximate level of the contact areas 18 is especially important when an electrical conductor is inserted with high insertion force between the contact springs 14 in case of a large number of lamellae. The plug connector 38 shown in FIG. 6 may have spacer lamellae of the type shown in FIG. 2 between the contact lamellae 10. They are not used in the design variant shown here.

In order to establish the contact, an electrical contactor—an insulated wire 62 in the design variant shown here—with the insulation stripped from its end is inserted into the slot 12 of the contact lamellae 10. The wire 62 passes perpendicularly through the contact lamellae 10. The stripped end of the wire 62 rests in the concave contact areas 18. Good contact is ensured, as described in FIG. 3. When the wire 62 is inserted into the slot 12 of the contact lamellae 10, the wire 62 passes between the flaps forming the tension relief 58, with the flaps pressing o cutting into the insulation 64 of the wire 62 like blades. Due to their angled orientation pointing towards the interior of the cage 48, i.e. in the direction of the contact lamellae 10, the flaps forming the tension relief 58 hold the wire 62 in the slot 12, i.e. in the contact areas between the contact springs 14. The tension relief 58 acts in longitudinal direction of the wire 62 and perpendicular to the contact lamellae 10. The plug connector 38 as proposed by the invention and shown in FIG. 6 forms a plug that makes contact, i.e. is connected electrically and mechanically with the wire 62 through simple insertion. Additional connections beside the insertion are not required, a disconnection of the wire 62 from the plug connector 38 is not intended.

Figure 7:
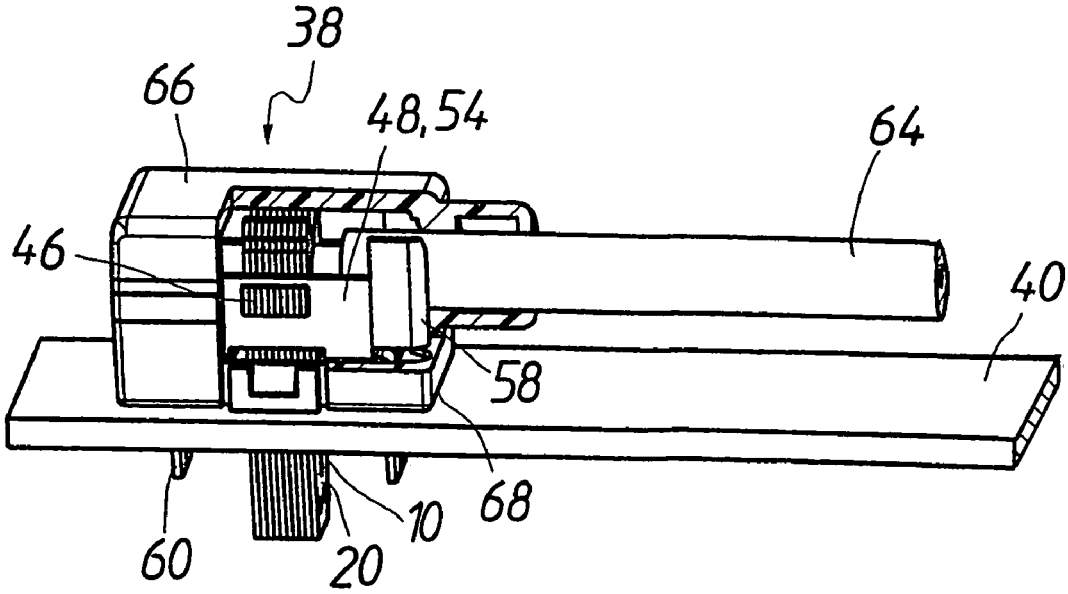
FIG. 7 shows the plug connector from FIG. 6 with housing.

After the contact has been made, an insulating housing 66 made of plastic may be placed on the plug connector 38, as can be seen in FIG. 7. The insulating housing 66 is shown cut open in FIG. 7 in order to show the plug connector 38. An edge of the insulating housing 66 that faces the conductor bar 40 forms a rest 68 that ensures the correct orientation of the contact lamellae 10 in the conductor bar 40, i.e. a perpendicular orientation in the design variant shown here. The edge of the insulating housing 66 forming the rest 68 augments the rest formed by the stops 22 of the contact lamellae 10. In addition, the insertion lugs 60 have lateral projections that form the stops 70 that are comparable with the stops 22 of the contact lamellae 10. The stops 70 of the insertion lugs 60 of the cage 48 form a rest for the plug connector that limits its insertion depth and ensures its correct orientation in the conductor bar 40. The stops 22 of the contact lamellae 10, the rests 70 of the insertion lugs 60 of the cage 48, and the edge of the insulating housing 66 augment each other as rests for the plug connector. In principle, one of the three measures described above would be sufficient in order to ensure the correct orientation of the plug connector in the conductor bar 40.

The plug connector 38 is inserted into a conductor bar 40 of a lead frame (not shown). Here, the foot sections 20 of the contact lamellae 10 are inserted through a square or rectangular stamped hole, and the insertion lugs 60 of the cage 48 are inserted into slots of the conductor bar 40. The cage 48 improves the electrical contact and the mechanical connection of the plug connector 38 with the conductor bar 40. The plug connector can be disconnected by pulling it out of the conductor bar 40.

The invention claimed is:

1. A plug connector, comprising:

at least two contact lamellae arranged congruently one behind the other in a lamellae packet, where the contact lamellae are stamped from sheet metal and have a slot that divides the contact lamellae into two contact springs, and where between the contact springs in the area of the slot a contact area for the conductor to be connected is provided; and a plug for plugging into a stamped hole of a conductor bar of a lead frame, wherein the foot section of the contact lamellae is shaped to form the plug, and the plug connector further comprises a metal cage holding the lamellae packet, and the cage has recesses that are engaged by projections of the contact springs of the contact lamellae, with a support and/or guide being located at the approximate level of the contact areas of the contact springs.

2. The plug connector according to claim 1, wherein a spacer lamella that is also stamped from sheet metal is placed between two contact lamellae that has the effect of creating a distance between the contact springs, arranged one behind the other, of the contact lamellae, where the spacer lamella has at least one barbed element with spring action and/or an insertion depth stop in the area of the slots, and that the foot section of the spacer lamellae is shaped to form the plug.

3. The plug connector according to claim 2, wherein the length of the insertion depth stop of the spacer lamella limits the insertion depth of the electrical conductor between the contact springs of the contact lamellae.

4. The plug connector according to claim 2, wherein the spacer lamella has two barbed elements with spring action that positively engage an electrical conductor inserted between the contact springs of the contact lamellae in a snap-type or latch-type connection.

5. The plug connector according to claim 1, wherein the cage has a tension relief for the electrical conductor.

6. The plug connector according to claim 1, wherein the cage has an insertion lug for insertion into a slot of the conductor bar.

7. The plug connector according to claim 1, wherein an insulating housing surrounds the cage.

8. The plug connector according to claim 1, wherein the plug connector has rests on the contact lamellae that hold the plug connector in the desired position on a conductor bar of the lead frame.

9. The plug connector according to claim 2, wherein the spacer lamella has two barbed elements with spring action that positively engage an electrical conductor inserted between the contact springs of the contact lamellae in a snap-type or latch-type connection.

10. The plug connector according to claim 5, wherein the cage has an insertion lug for insertion into a slot of the conductor bar.

11. The plug connector according to claim 5, wherein an insulating housing surrounds the cage.

12. The plug connector according to claim 6, wherein an insulating housing surrounds the cage.

13. The plug connector according to claim 6, wherein the plug connector has rests on the insertion lug of the cage that hold the plug connector in the desired position on a conductor bar of the lead frame.

14. The plug connector according to claim 7, wherein the plug connector has a rest on the insulating housing that holds the plug connector in the desired position on a conductor bar of the lead frame.

* * * * *